US008316675B2

(12) United States Patent
Yang

(10) Patent No.: US 8,316,675 B2
(45) Date of Patent: Nov. 27, 2012

(54) DUAL LOCKING DEVICE

(76) Inventor: Yao Kun Yang, Chang-Hua County (TW)

( * ) Notice: Subject to any disclaimer, the term of this patent is extended or adjusted under 35 U.S.C. 154(b) by 96 days.

(21) Appl. No.: 13/010,780

(22) Filed: Jan. 21, 2011

(65) Prior Publication Data

US 2012/0186313 A1 Jul. 26, 2012

(51) Int. Cl.
*E05B 37/00* (2006.01)

(52) U.S. Cl. ..... 70/285; 70/21; 70/78; 70/213; 70/284

(58) Field of Classification Search ..... 70/21, 208, 70/312, 284, 285, DIG. 63, DIG. 71, 213, 70/215–217, 78–84, 219, 221–224, 190, 70/191
See application file for complete search history.

(56) References Cited

U.S. PATENT DOCUMENTS 3,383,886 A * 5/1968 Hermann ..... 70/284
5,077,996 A * 1/1992 Lien ..... 70/284
5,237,842 A * 8/1993 Rasch et al. ..... 70/285
6,513,351 B2 * 2/2003 Clark ..... 70/101
7,444,844 B1 * 11/2008 Lee ..... 70/21
7,958,757 B1 * 6/2011 Lee ..... 70/21
8,087,274 B2 * 1/2012 Yu et al. ..... 70/284
8,141,400 B2 * 3/2012 Sorensen et al. ..... 70/279.1
2007/0214850 A1 * 9/2007 Ma ..... 70/284
2008/0110216 A1 * 5/2008 Dalton et al. ..... 70/21
2009/0107193 A1 * 4/2009 Lee ..... 70/284

* cited by examiner

*Primary Examiner* — Lloyd Gall
*Assistant Examiner* — Myles Throop

(57) ABSTRACT

A dual locking device includes a first casing and a second casing. A receiving space is defined between the first casing and the second casing. The second casing has a through hole defined therein. An axial shaft passes through the through hole. A latch member is connected with the axial shaft. A locking mechanism and a key operated mechanism are received in the receiving space. The locking mechanism is connected with the axial shaft for driving the axial shaft. The key operated mechanism has a lock core disposed therein and having a key hole defined therein for being inserted and rotated by a key, such that the lock core drives the axial shaft. Accordingly, the locking mechanism and the key operated mechanism are separately operable to move the latch member between a locking position and an unlocking position.

6 Claims, 7 Drawing Sheets

DUAL LOCKING DEVICE

BACKGROUND OF THE INVENTION

1. Field of the Invention

The present invention relates to a dual locking device and more particularly to a locking device having two mechanisms which are able to be separately operated for moving a latch member between a locking position and an unlocking position.

2. Description of Related Art

A conventional key and combination lock in accordance with the prior art shown in FIG. 7 comprises a housing 80, and a latch component 82 movably connected with the housing 80; a key lock 81 and a combination lock 83 are movably received in the housing 80. The key lock 81 has a key hole (not shown) defined therein for being inserted by a key (not shown). An arm 811 is received in the housing 80 and fixedly connected with the key lock 81. The combination lock 83 includes a plurality of inner rings 831 which are coaxially disposed thereon and a plurality of numeral outer wheels 832 which coaxially and respectively sleeve on the inner rings 831. Each inner ring 831 has a flat portion 8311 formed on an outer periphery thereof. A keeper 84 is disposed beside the combination lock 83 to abut against the outer periphery of the inner rings 831. The keeper 84 has two ends respectively and selectively engaged with one end of the arm 811 and one end of the latch component 82.

When the keeper 84 abuts against the outer periphery of the inner rings 831, the first end 841 of the keeper 84 engages with the latch component 82 to retain the latch component 82 in a locked position. When the outer wheels 832 are rotated to drive the inner rings 831, the flat portions 8311 of the inner rings 831 are aligned for allowing the keeper 84 to rest against the flat portions 8311, such that the keeper 84 is moved up and the latch component 82 is able to turn to an unlocked position. Moreover, when the inner rings 831 restrictedly abut against the keeper 84, the key lock 81 is inserted and rotated by the key. The arm 811 is rotated with key lock 81 to engage with the second end 842 of the keeper 84. Then the keeper 84 moves downwardly to disengage from the latch component 82, such that the latch component 82 is free to turn to the unlock position.

The key lock 81 is operable to unlock the conventional key and component lock. However, when the keeper 84 is lift by the arm 811 to disengage from the latch component 82, the combination lock 83 is easily jammed by an abutting force of the keeper 84. Moreover, if a user wants to operate the combination lock 83, the user needs to rotate the key lock 81 by the key to move the arm 811 from the second end 842 of the keeper 84. Therefore, it is inconvenient to use the conventional key and combination lock.

The present invention has arisen to mitigate and/or obviate the disadvantages of the conventional key and combination lock.

SUMMARY OF THE INVENTION

The main objective of the present invention is to provide an improved dual locking device.

To achieve the objective, a dual locking device comprises a first casing and a second casing rotatably connected with the first casing. A receiving space is defined between the first casing and the second casing. The first casing has a plurality of openings defined in a top thereof and extending therethrough. The first casing has an aperture defined in a peripheral wall thereof and extending therethrough. The second casing has an engaging recess defined in a peripheral wall thereof and extending therethrough. The second casing has a through hole defined in a bottom thereof.

A base is received in the receiving space and fixedly connected with the first casing. The base has an axial hole defined therein and extending therethrough. The axial hole coaxially corresponds to the through hole of the second casing. An axial shaft sequentially passes through the axial hole and the through hole of the second casing. The axial shaft is driven by the base and is rotatable relative to the second casing. A latch member is fixedly connected with the axial shaft for moving with the axial shaft.

A locking mechanism is received in the receiving space and moves with the first casing. The locking mechanism is a combination locking mechanism and comprises a rod movably connected with the first casing, a plurality of sleeves coaxially sleeving on the rod and arranged in series, a plurality of numeral wheels coaxially and respectively sleeving on the sleeves, and a buckling member disposed adjacent to the numeral wheels. Each sleeve has an indentation defined in an outer periphery thereof. Each numeral wheel is releasably engaged with the corresponding sleeve for simultaneously rotating with the sleeve. The numeral wheels respectively and correspondingly passes through the openings so as to be partially exposed through the openings. The buckling member has an engaging arm formed thereon for selectively engaging with the engaging recess in the second casing. The buckling member has a plurality of protrusions formed thereon. Each protrusion correspondingly abuts against the outer periphery of the corresponding sleeve and selectively engages with the corresponding indentation.

Moreover, the locking mechanism comprises two positioners, a pusher, and a spring. The two positioners are respectively disposed on two ends of the rod. The pusher is disposed on one end of the rod and passes through the aperture in the first casing so as to be partially exposed through the aperture. The spring coaxially sleeves on the other end of the rod which is opposite to the pusher. The spring has two ends respectively abutting against the corresponding sleeve and the corresponding positioner for providing a resilient force.

A key operated mechanism is received in the receiving space. The key operated mechanism has a lock core disposed therein and has a connecting portion formed in one end thereof. The lock core has a key hole defined in the other end thereof which is opposite to the connecting portion for adapting to be inserted and be rotated by a key. The key operated mechanism has a gear set disposed therein. The gear set has a first gear wheel fixedly mounted with the connecting portion of the lock core for simultaneously moving with the lock core, a second gear wheel rotatably engaged with the first gear wheel, and a third gear wheel rotatably engaged with the second gear wheel and non-rotatably connected with one end of the axial shaft for driving the axial shaft.

When the numeral wheels turn to a preset code, the sleeves are rotated with the numeral wheels and the indentations are aligned to simultaneously engage with the protrusions of the buckling member, such that the buckling member is moved toward the first casing and the engaging arm is released from the engaging recess. As rotating the first casing relative to the second casing, the base is rotated with the first casing and drives the axial shaft. The latch member is moved by the axial shaft from a locking position to an unlocking position. When the lock core is rotated by the key to drive the first gear wheel, the first gear wheel drives the second gear wheel. The second gear wheel drives the third gear wheel. The axial shaft is rotated by the third gear wheel, and the latch member is turned to the locking position or the unlocking position. Therefore, the locking mechanism and the key operated mechanism are separately operable to move the latch member between the locking position and the unlocking position.

Additionally, as re-coding the locking mechanism, the pusher is pressed inwardly to abut against the rod. The rod moves the sleeves to disengage from the numeral wheels and the spring is compressed by the sleeves. The numeral wheels are separately rotated for recoding. When the pusher is released, the sleeves are restored to engage with the numeral wheels by the resilient force of the spring.

Further benefits and advantages of the present invention will become apparent after a careful reading of the detailed description with appropriate reference to the accompanying drawings.

DETAILED DESCRIPTION OF THE INVENTION

Figure 1:
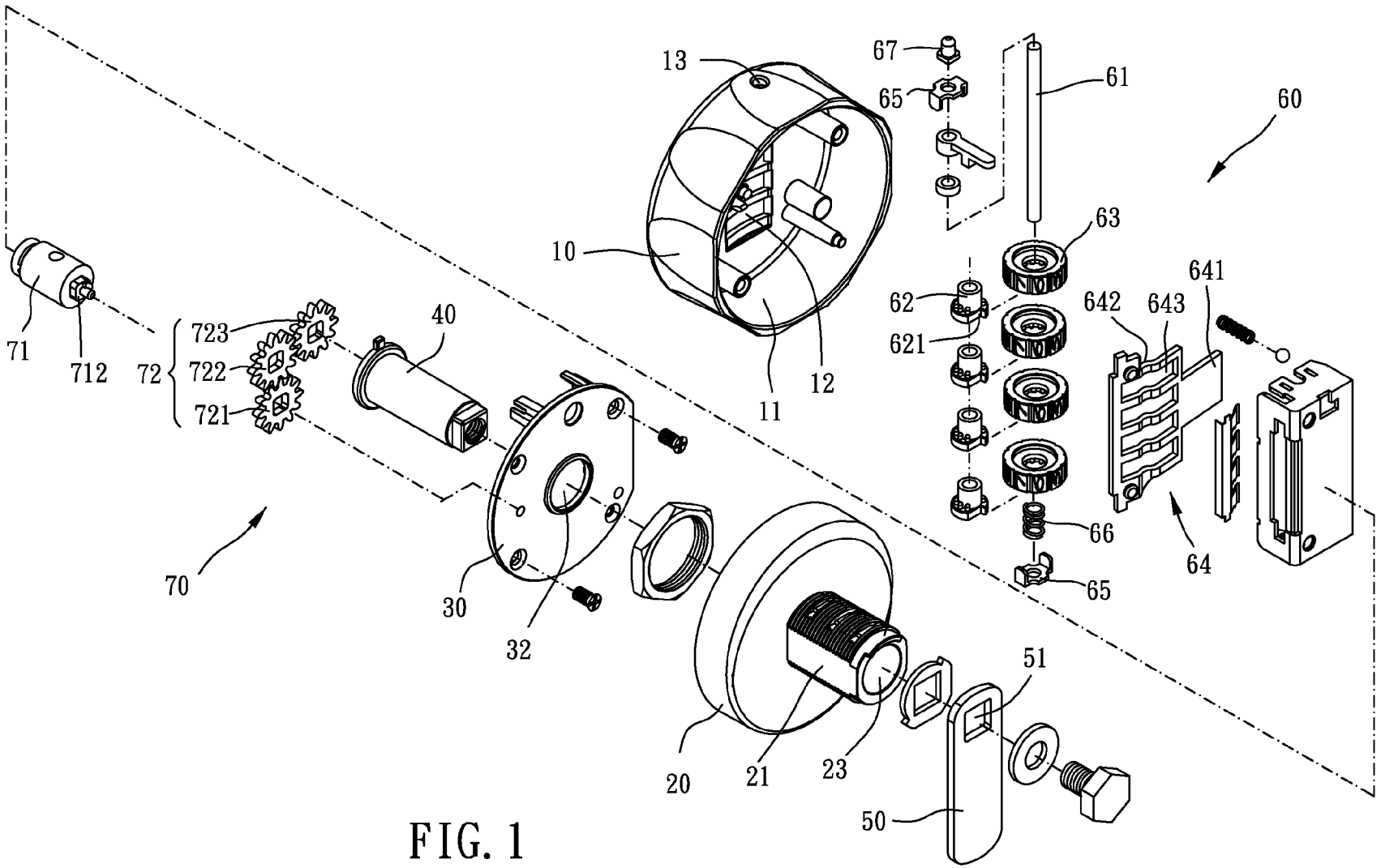
FIG. 1 is an exploded perspective view of a dual locking device in accordance with the present invention.
Figure 2:
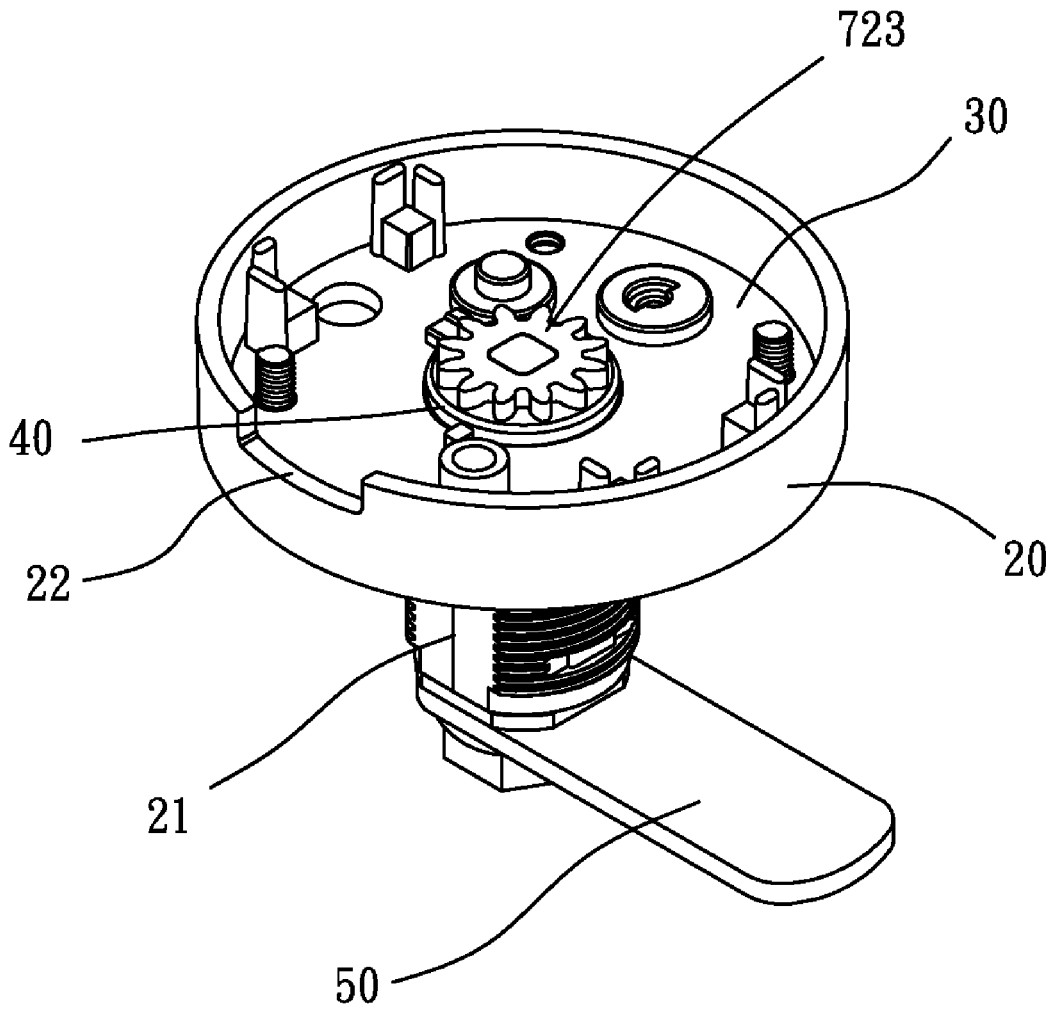
FIG. 2 is a partially assembled perspective view of the dual locking device in accordance with the present invention.
Figure 3:
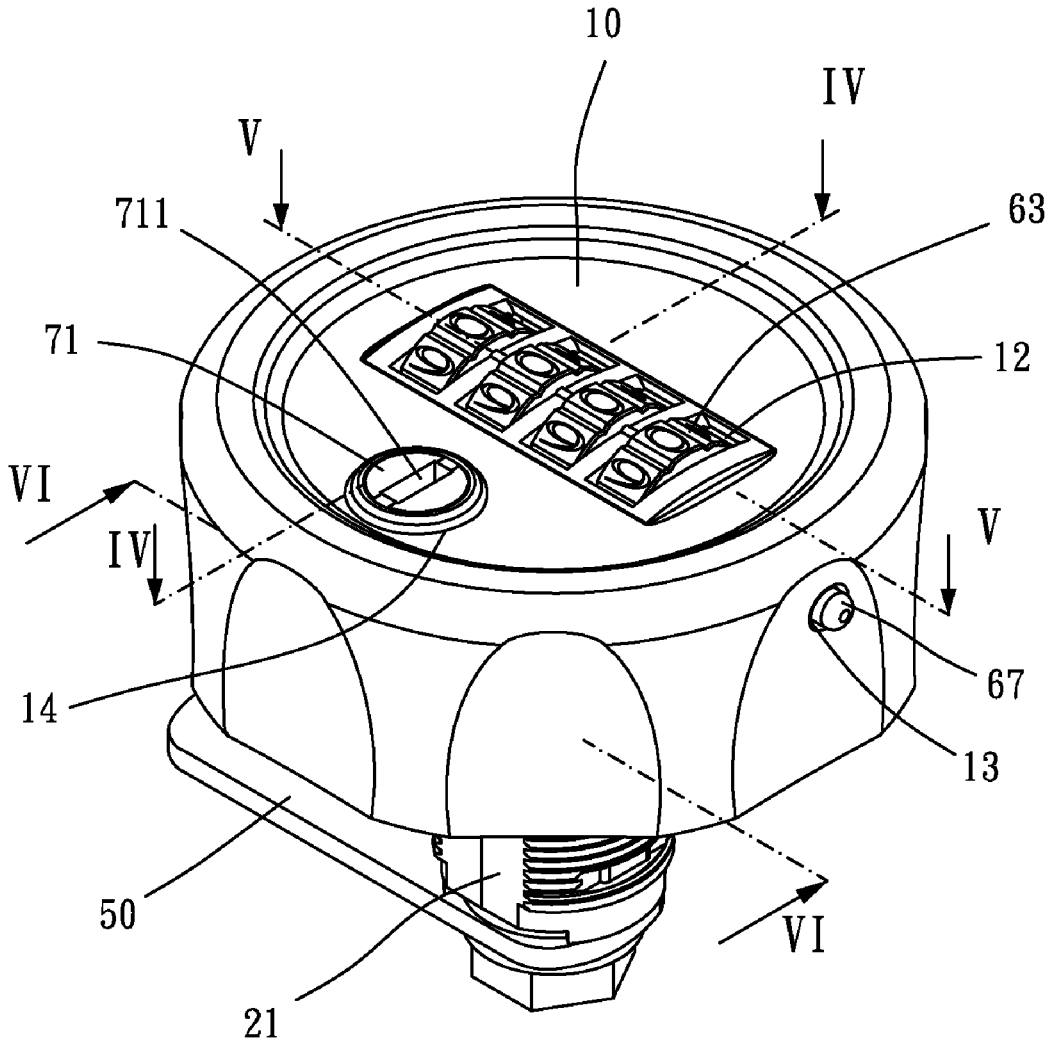
FIG. 3 is an assemble perspective view of the dual locking device in accordance with the present invention.

Referring to the drawings to FIGS. 1-3, a dual locking device in accordance with the present invention comprises a first casing 10 and a second casing 20 rotatably connected with the first casing 10. A receiving space 11 is defined between the first casing 10 and the second casing 20. In the preferred embodiment, the first casing 10 has four openings 12 and a core hole 14 defined in a top thereof and extending therethrough. Each opening 12 is substantially rectangular. The first casing 10 has an aperture 13 defined in a peripheral wall thereof and extending therethrough for communicating with the receiving space 11. The second casing 20 has an engaging recess 22 defined in a peripheral wall thereof and extending therethrough for communicating with the receiving space 11. The second casing 20 has a tubular member 21 disposed thereon and extending from the bottom thereof. The second casing 20 has a through hole 23 defined therein and axially extending from the bottom of the second casing 20 to the tubular member 21.

A base 30 is received in the receiving space 11 and fixedly connected with the first casing 10. The base 30 has an axial hole 32 defined therein and extending therethrough. The axial hole 32 coaxially corresponds to the through hole 23 of the second casing 20. An axial shaft 40 sequentially passes through the axial hole 32 and the through hole 23 of the second casing 20 to have one end extended from the tubular member 21. The axial shaft 40 is driven by the base 30 and is rotatable relative to the second casing 20. A latch member 50 has a bore 51 defined in one end thereof and fixedly mounted with the end of the axial shaft 40 for moving with the axial shaft 40.

A locking mechanism 60 is received in the receiving space 11 and moves with the first casing 10. The locking mechanism 60 is a combination locking mechanism and comprises a rod 61 movably connected with the first casing 10, four sleeves 62 coaxially sleeving on the rod 61 and arranged in series, four numeral wheels 63 coaxially and respectively sleeving on the sleeves 62, and a buckling member 64 disposed adjacent to the numeral wheels 63. Each sleeve 62 has an indentation 621 defined in an outer periphery thereof. Each numeral wheel 63 is releasably engaged with the corresponding sleeve 62 for simultaneously rotating with the sleeve 62. The four numeral wheels 63 respectively and correspondingly pass through the four openings 12 so as to be partially exposed through the four openings 12.

The buckling member 64 has an engaging arm 641 formed on one end thereof for selectively engaging with the engaging recess 22 in the second casing 20. The buckling member 64 has four hollow portions 643 defined in the other end thereof and corresponding to the four numeral wheels 63, such that the four numeral wheels 63 respectively pass through the four hollow portions 643. Four protrusions 642 are formed on the buckling member and each protrusion 642 is located adjacent to the corresponding hollow portion 643. Each protrusion 642 correspondingly abuts against the outer periphery of the corresponding sleeve 62 and selectively engages with the corresponding indentation 621.

Moreover, the locking mechanism 60 comprises two positioners 65, a pusher 67, and a coil spring 66. The two positioners 65 are respectively disposed on two ends of the rod 61. The pusher 67 is disposed on one end of the rod 61 and passes through the aperture 13 in the first casing 10 so as to be partially exposed through the aperture 13. The coil spring 66 coaxially sleeves on the other end of the rod 61 which is opposite to the pusher 67. The coil spring 66 has two ends respectively abutting against the corresponding sleeve 62 and the corresponding positioner 65 for providing a resilient force.

A key operated mechanism 70 is received in the receiving space 11. The key operated mechanism 70 has a lock core 71 which has one end held in the core hole 14 of the first casing 10. A key hole 711 is defined in the end thereof for adapting to be inserted and be rotated by a key (not shown). The lock core 71 has a connecting portion 712 formed in the other end thereof which is opposite to the key hole 711. The key operated mechanism 70 has a gear set 72 disposed therein. The gear set 72 has a first gear wheel 721 fixedly mounted with the connecting portion 712 of the lock core 71 for simultaneously moving with the lock core 71, a second gear wheel 722 rotatably engaged with the first gear wheel 721, and a third gear wheel 723 rotatably engaged with the second gear wheel 722 and non-rotatably connected with one end of the axial shaft 40 for driving the axial shaft 40.

Figure 4A:
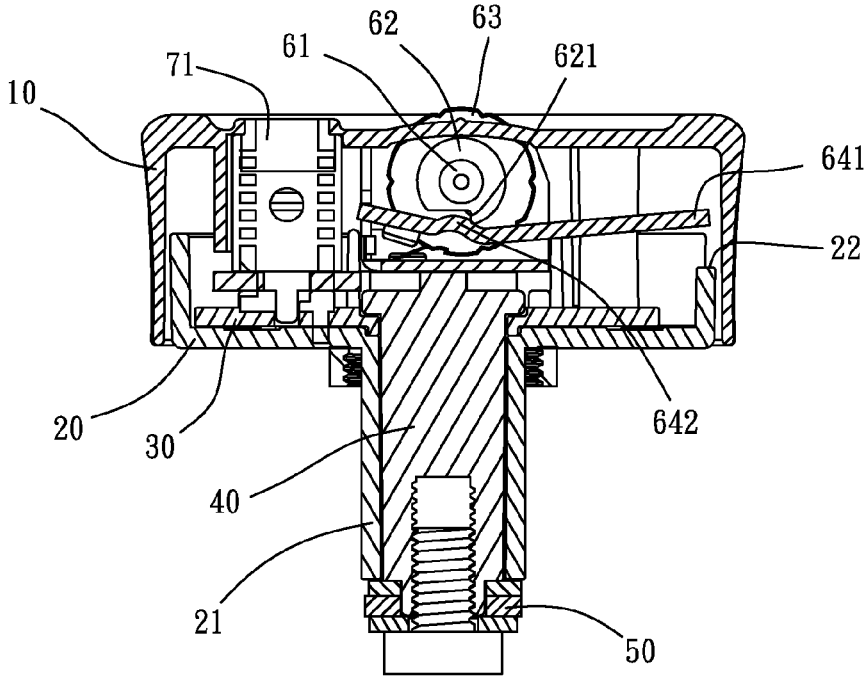
FIGS. 4*a*-4*b* are operational cross-sectional views of a locking mechanism of the dual locking device in accordance with the present invention taken along line IV-IV in FIG. 3.
Figure 4B:
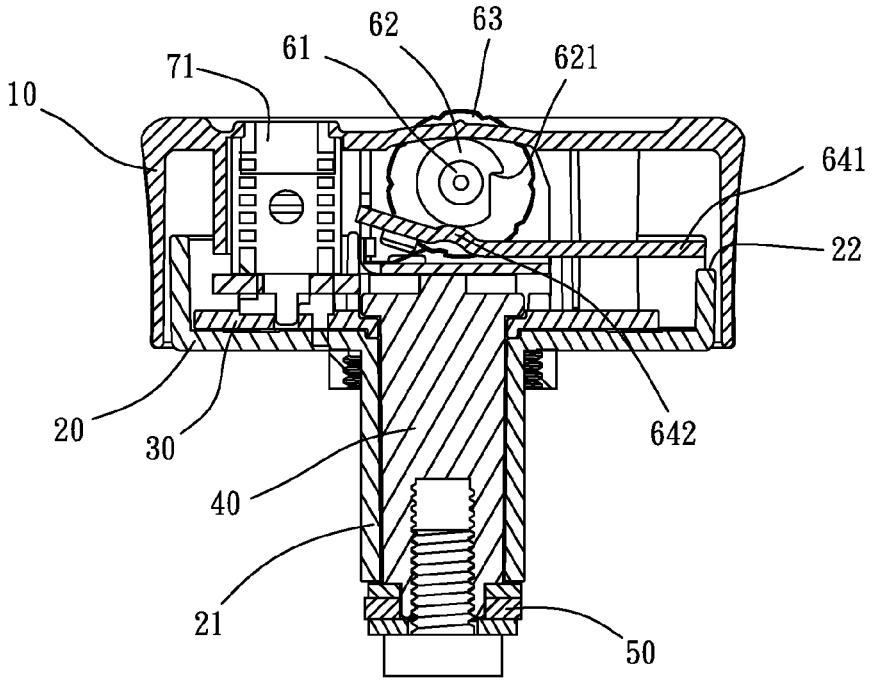
Figure 6:
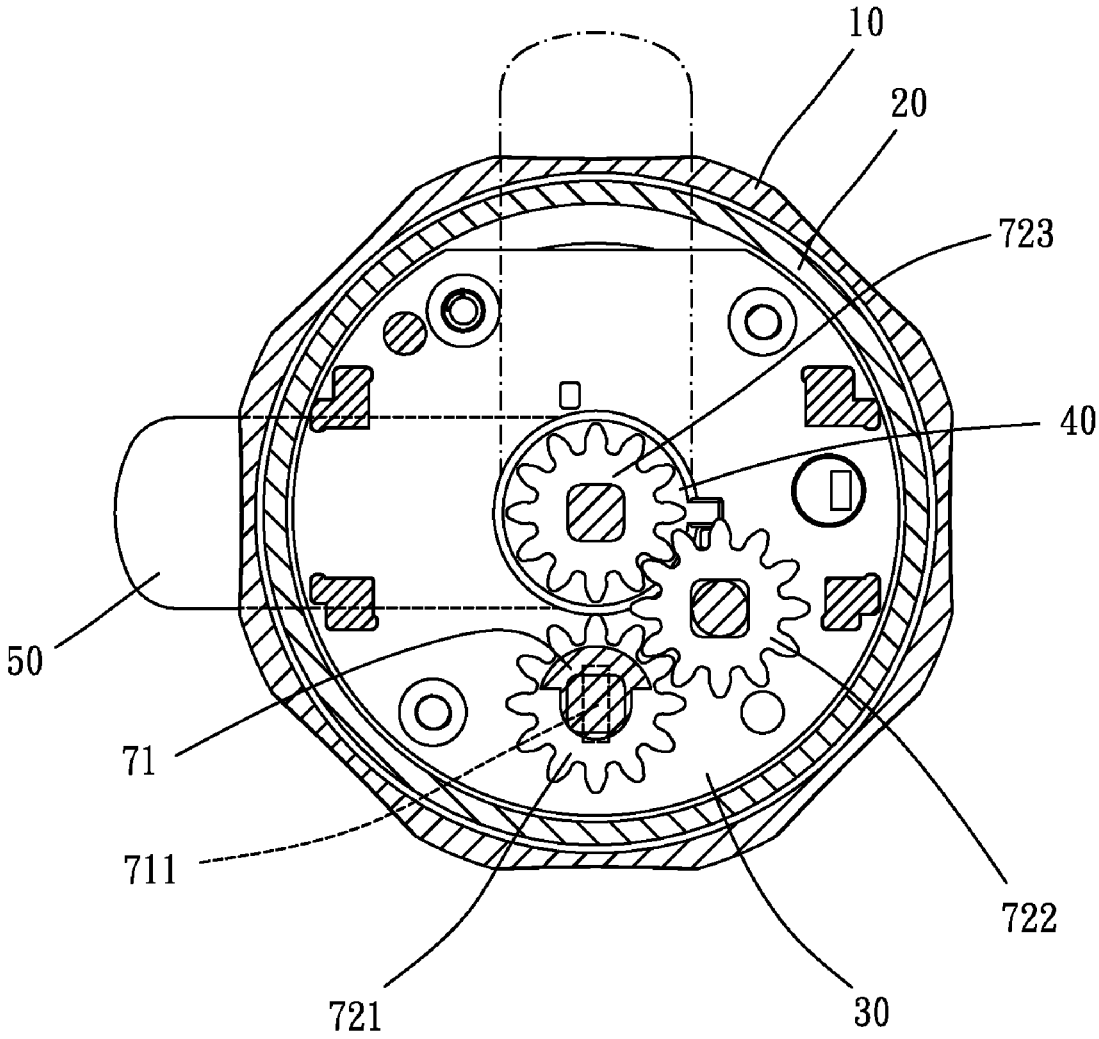
FIG. 6 is an operational cross-sectional view of a key operated mechanism of the dual locking device in accordance with the present invention taken along line VI-VI in FIG. 3.
Figure 7:
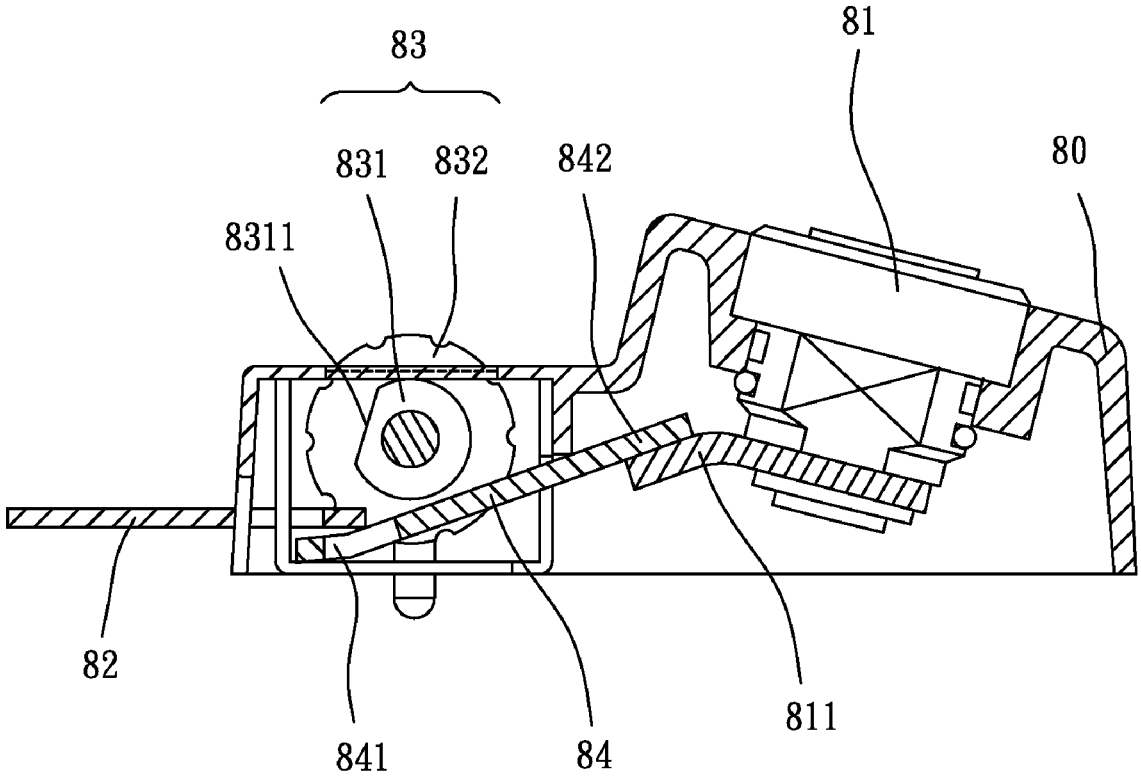
FIG. 7 (prior art)
FIG. 7 is a cross-sectional view of a key and combination lock in accordance with the prior art.

The operation of the dual locking device in accordance with the present invention will be described in detailed below. As shown in FIGS. 4*a*-4*b*, when the four numeral wheels 63 turn to a preset code (not shown), the four sleeves 62 are separately rotated with the four numeral wheels 63 and the four indentations 621 are aligned to simultaneously engage with the four protrusions 642, such that the buckling member 64 is moved toward the first casing 10 and the engaging arm 641 is released from the engaging recess 22. As rotating the first casing 10 relative to the second casing 20, the base 30 is rotated with the first casing 10 and drives the axial shaft 40. The latch member 50 is moved by the axial shaft 40 from a locking position to an unlocking position. As shown in FIG. 6, when the lock core 71 is rotated by the key (not shown) to drive the first gear wheel 721, the first gear wheel 721 rotatably drives the second gear wheel 722. The second gear wheel 722 rotatably drives the third gear wheel 723. The axial shaft 40 is rotated by the third gear wheel 723, and the latch member 50 is turned to the locking position or the unlocking position. Therefore, the locking mechanism 60 and the key operated mechanism 70 are separately operable to move the latch member 50 between the locking position and the unlocking position.

Figure 5:
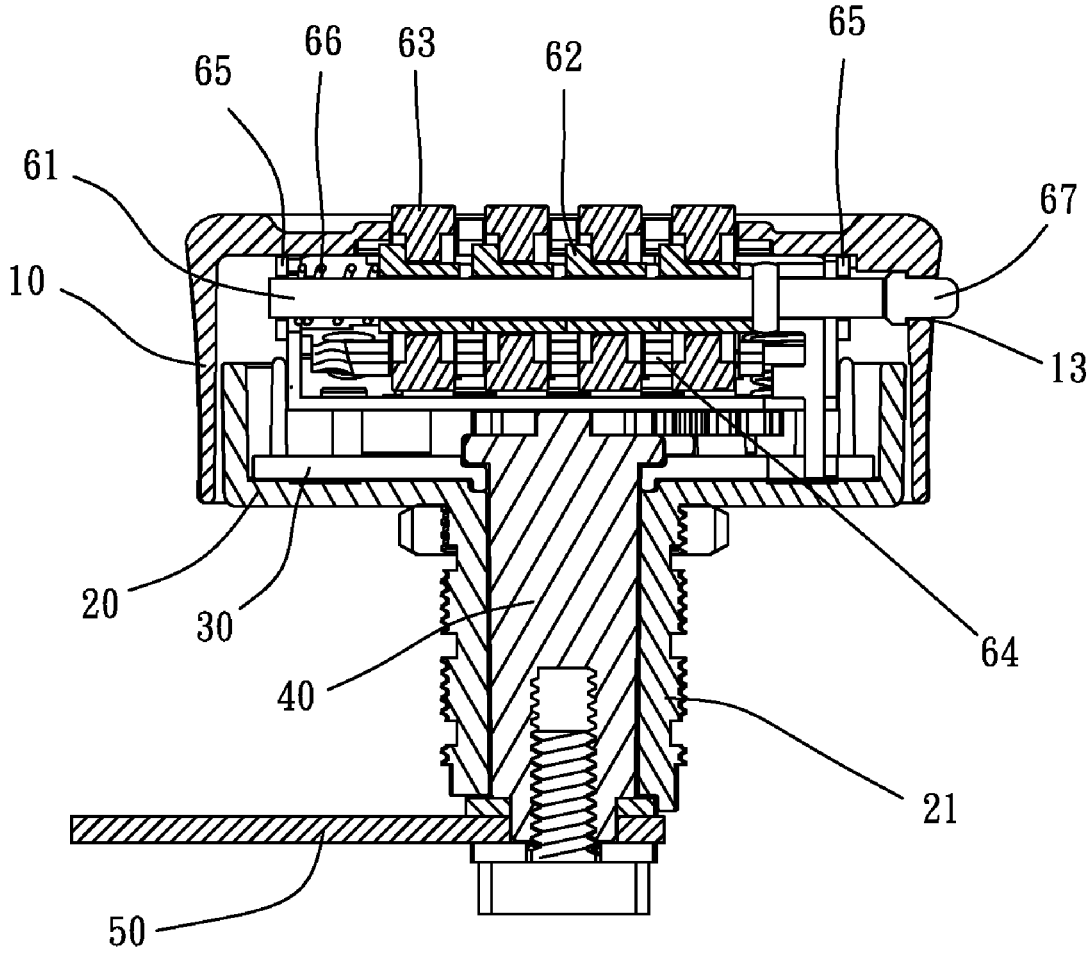
FIG. 5 is a cross-sectional view of the dual locking device in accordance with the present invention taken along line V-V in FIG. 3.

Additionally, as shown in FIG. 5, when re-coding the locking mechanism 60, the pusher 67 is pressed inwardly to abut against the rod 61. The rod 61 moves the four sleeves 62 to disengage from the four numeral wheels 63 and the coil spring 66 is compressed by the sleeves 62. The four numeral wheels 63 are separately rotatable for recoding. When the pusher 67 is released, the four sleeves 62 are restored to engage with the four numeral wheels 63 by the resilient force of the coil spring 66.

Although the invention has been explained in relation to its preferred embodiment, it is to be understood that many other possible modifications and variations can be made without departing from the spirit and scope of the invention as hereinafter claimed.

What is claimed is:

1. A dual locking device comprising:

a first casing and a second casing rotatably connected with the first casing, a receiving space defined between the first casing and the second casing, the second casing having a through hole defined therein;

an axial shaft passing through the through hole of the second casing and being rotatable relative to the second casing;

a latch member connected with the axial shaft for moving with the axial shaft;

a locking mechanism received in the receiving space, the locking mechanism connected with the axial shaft for driving the axial shaft; and a key operated mechanism received in the receiving space and connected with the axial shaft, the key operated mechanism having a lock core disposed therein, the lock core having a key hole defined in one end thereof for adapting to be inserted by a key, such that the lock core adapts to be rotated by the key to drive the axial shaft, the key operated mechanism having a gear set disposed therein and connected with a bottom of the lock core for moving with the lock core, the gear set connected with the axial shaft for driving the axial shaft, the lock core having a connecting portion formed in one end thereof opposite to the key hole, the gear set having a first gear wheel fixedly mounted with the connecting portion, a second gear wheel rotatably engaged with the first gear wheel, a third gear wheel rotatably engaged with the second gear wheel and non-rotatably connected with one end of the axial shaft;

wherein the locking mechanism and the key operated mechanism are separately operable to move the latch member between a locking position and an unlocking position.

2. The dual locking device as claimed in claim 1, wherein the second casing has an engaging recess defined in a peripheral wall thereof and extending therethrough.

3. The dual locking device as claimed in claim 1 further comprising a base received in the receiving space, the base fixedly connected with the first casing, the base having an axial hole defined therein and extending therethrough, the axial hole coaxially corresponding to the through hole of the second casing, wherein the axial shaft sequentially passes through the axial hole and the through hole so as to be driven by the base and be rotatable relative to the second casing.

4. The dual locking device as claimed in claim 3, wherein the locking mechanism is a combination locking mechanism and moves with the first casing, the locking mechanism comprising:

a rod movably connected with the first casing;

a plurality of sleeves coaxially sleeving on the rod and arranged in series, each sleeve having an indentation defined in an outer periphery thereof;

a plurality of numeral wheels coaxially and respectively sleeving on the sleeves, each numeral wheel releasably engaged with the corresponding sleeve for simultaneously rotating with the sleeve; and a buckling member disposed adjacent to the numeral wheels, the buckling member having an engaging arm formed thereon for selectively engaging with an engaging recess in the second casing, the buckling member having a plurality of protrusions formed thereon, each protrusion correspondingly abutting against the outer periphery of the corresponding sleeve and selectively engaging with the corresponding indentation;

wherein when the numeral wheels turn to a preset code, the sleeves are rotated with the numeral wheels and the indentations are aligned to simultaneously engage with the protrusions of the buckling member, such that the buckling member is moved toward the first casing and the engaging arm is released from the engaging recess.

5. The dual locking device as claimed in claim 4, wherein the first casing has a plurality of openings defined therein and extending therethrough, the openings respectively corresponding to the numeral wheels, such that the numeral wheels are partially exposed through the openings, the first casing having an aperture defined in a peripheral wall thereof and extending therethrough.

6. The dual locking device as claimed in claim 5, wherein the locking mechanism comprises two positioners, a pusher and a spring, the two positioners respectively disposed on two ends of the rod, the pusher disposed on one end of the rod and passing through the aperture in the first casing for being partially exposed through the aperture, the spring coaxially sleeving on the other end of the rod opposite to the pusher, the spring having two ends respectively abutting against the corresponding sleeve and the corresponding positioner for providing a resilient force;

wherein when the pusher is pressed inwardly, the pusher abuts against the rod to move the sleeves for disengaging from the numeral wheels, the spring being compressed, the numeral wheels being separately rotatable for recoding; when the pusher is released, the sleeves are restored to engage with the numeral wheels by the resilient force of the spring.

* * * * *